US005651411A

United States Patent [19]

Hirano et al.

[11] Patent Number: 5,651,411

[45] Date of Patent: Jul. 29, 1997

[54] APPARATUS FOR AND METHOD OF CONTINUOUS CASTING

[75] Inventors: Satoshi Hirano; Yutaka Fukui, both of Hitachi; Hideyo Kodama, Katsuta; Toshiyuki Kajiwara, Tokyo; Yasutsugu Yoshimura, Hitachi; Tomoaki Kimura, Hitachi; Kenji Horii, Hitachi; Tadashi Nishino, Hitachi, all of Japan

[73] Assignee: Hitachi, Ltd., Japan

[21] Appl. No.: 461,006

[22] Filed: Jun. 5, 1995

Related U.S. Application Data

[62] Division of Ser. No. 364,772, Dec. 27, 1994 .

[30] Foreign Application Priority Data

| | | | |
|---|---|---|---|
| Dec. 27, 1993 | [JP] | Japan | 5-331044 |
| Mar. 16, 1994 | [JP] | Japan | 6-045372 |

[51] Int. Cl.[6] ..... B22D 11/04

[52] U.S. Cl. ..... 164/459; 164/154.7; 164/416; 164/418

[58] Field of Search ..... 164/418, 416, 164/459, 154.7

[56] References Cited

U.S. PATENT DOCUMENTS 5,201,361 4/1993 Grove et al. .

FOREIGN PATENT DOCUMENTS

| | | | |
|---|---|---|---|
| 4201363 | 7/1993 | Germany . | |
| 58-218353 | 12/1983 | Japan . | |
| 59-120349 | 7/1984 | Japan | 164/418 |
| 60-40660 | 3/1985 | Japan | 164/416 |
| 61-209750 | 9/1986 | Japan | 164/418 |
| 62-176647 | 8/1987 | Japan | 164/418 |
| 62-224454 | 10/1987 | Japan | 164/418 |
| 3-8541 | 1/1991 | Japan . | |
| 58-122107 | 7/1993 | Japan . | |
| WO 93/00179 | 1/1993 | WIPO . | |
| WO94/07628 | 4/1994 | WIPO . | |

OTHER PUBLICATIONS

Patent Abstracts of Japan, vol. 009, No. 142 (M–388) , 18 Jun. 1985 & JPA60–021153 (Nitsushin Seikou KK) Feb. 2, 1985.

Patent Abstracts of Japan, vol. 007, No. 112 (M–215) , 17 May 1983 & JP58–32552 (Kawasaki Seitetsu KK) 25 Feb. 1983.

Patent Abstracts of Japan, vol. 012 No. 464 (M–771) , 6 Dec. 1988 & JPA63–188451 (ChuetsuGokin Chuko KK) 4 Aug. 1988.

*Primary Examiner*—J. Reed Batten, Jr.

*Attorney, Agent, or Firm*—Evenson, McKeown, Edwards & Lenahan P.L.L.C.

[57] ABSTRACT

The apparatus is formed by confronting wide side mold walls and confronting narrow side mold walls, The narrow side mold walls are composed of an electrically conductive refractory material and are directly heated. Each of the narrow side mold walls include an upper squeezed portion and a lower parallel portion, The upper squeezed portion has a surface in contact with the molten metal which converges in width along a casting direction. The lower parallel portion has surface in contact with the molten metal which is substantially uniform in width.

19 Claims, 14 Drawing Sheets

APPARATUS FOR AND METHOD OF CONTINUOUS CASTING

This is a divisional of application Ser. No. 08/364,772, filed Dec. 27, 1994.

BACKGROUND OF THE INVENTION

1. Field of the Invention

The present invention relates to a continuous casting apparatus for continuously making a product having a long size with a predetermined cross section by continuously drawing molten metal while solidifying the molten metal in a passing-through mold and to a continuous rolling system integrated with the continuous casting apparatus.

2. Description of the Prior Art

A metal sheet is usually made in such a manner that molten metal is first continuously cast and made to an ingot (sheet-shaped ingot) and then rolled. Since the ingot generally has a thickness of about 200 mm, when a metal sheet of 10 mm or less in thickness is to be made, many rolling processes are needed. On the other hand, when a continuous thin metal sheet casting method capable of producing a thin ingot is employed, the number of rolling processes can be reduced. In this case, however, a casting speed must be increased to secure an output. At the same time, when the thickness of an ingot is reduced, since a space through which a molten metal pouring nozzle for pouring molten metal into a mold is made small, a molten metal pouring nozzle inserting portion is devised to be enlarged. This technology is disclosed in, for example, DE 42 01 363, Japanese Patent Unexamined Publication No. 58-218353 (1983), Japanese Patent Unexamined Publication No. 3-8541 (1991) and the like.

According to the above technology (DE 42 01 363), since the molten metal pouring nozzle inserting portion is enlarged, the molten metal pouring nozzle can be easily inserted, so that a thin ingot can be made. In this technology, however, the ingot must be made to a predetermined configuration by three-dimensionally deforming a solidified shell in a mold until the molten metal reaches the outlet of the mold. In the process of the three-dimensional deformation, a tensile force and a compression force are applied to the outside surface and inside surface of the solidified shell. In particular, when a casting speed is increased, since the solidified shell is made thin and a strain speed is increased, there is a possibility that crack may be caused to the solidified shell. Further, although it is required to uniformly cool a wide side surface from the view point of the increase of a casting speed and the prevention of crack, the three-dimensional deformation has a problem difficult to cope with this requirement. Furthermore, there is a problem that long castings are difficult to be processed and maintenance is also a problem.

According to Japanese Patent Unexamined Publication No. 58-218353 (1983), since a solidified shell is two-dimensionally deformed in a mold only in the thickness direction of an ingot, a less force is applied to the solidified shell. Further, since a moving mold is employed to wide side mold walls, this technology is advantageous to high speed casting. In this technology, however, a gap is liable to be formed at the positions where the moving wide side mold walls come into contact with fixed narrow side mold walls, and thus an undesirable solidified shell is grown from molten metal flowing into the gap, by which break-out is caused. Therefore, this technology has a problem that casting cannot be stably carried out. Further, since the solidified shells on the narrow side mold walls are unnaturally deformed in the process of two-dimensional deformation, a problem arises to the quality of the ingot on the narrow side mold walls.

According to Japanese Patent Unexamined Publication No. 3-8541 (1991), since a solidified shell is two-dimensionally deformed as well as both wide side mold walls and narrow side mold walls are composed of fixed molds, this technology intends to solve the above problem. However, this technology does not consider well the prevention of a solidified shell created in the narrow side mold walls. That is, although the technology employs a low thermal conductivity type material to the narrow side mold walls, this material is insufficient to prevent the creation of the solidified shell. Therefore, the solidified shell is created to the surfaces of the narrow side mold walls while casting and a large drawing resistant force is produced in a squeezing process, so that the quality of the ingot on the narrow side mold walls is deteriorated as well as break-out is caused. Further, the technology does not sufficiently consider the flow-in of mold powder. That is, in the technology by which the upper portion of the mold is enlarged, it is difficult for mold powder to flow between the mold and a solidified shell. Therefore, a problem arises in that when casting is carried out at high speed, lubrication between the mold and the solidified shell is insufficiently effected so that break-out is liable to be caused.

SUMMARY OF THE INVENTION

An object of the present invention is to provide a manufacturing system integrated from continuous casting to rolling having a short production line which is achieved by the combination of a continuous casting apparatus and hot rolling mills so that a thin slab ingot of high quality can be made at high speed by preventing the solidification of an ingot at the squeezed portion of a mold and making the drawing Of the ingot easy.

The problems of the present invention are solved by narrowing the width of each of the narrow side mold walls from a molten metal surface toward a casting direction and providing heating means on the surface of each of the narrow side mold walls in contact with molten metal to thereby heat the narrow side ingots to high temperature so that the creation of a solidified shell on the surfaces of the narrow side mold walls is positively prevented. Further, it is possible that the preheating temperature of the narrow side mold walls is controlled to temperature higher than the liquids temperature of the molten metal, an ingot coming from the fixed mold is supported by a secondary cooling body composed of an cooled endless track such as a cooled belt or the like, the ingot is supported by support rolls of small diameter which are supported by back-up rolls, and an electromagnetic force is applied to the molten metal in the mold.

It is preferable that a heating unit composed of electric conductive ceramics is provided on the surface of the squeezed portion of each of the narrow side mold walls in contact with the molten metal so that the molten metal is not solidified on the squeezed portions of the narrow side mold walls.

It is preferable that there are provided temperature measuring means on the vicinity of each of the narrow side mold walls in contact with a molten metal surface and control means for effecting control so that the temperature of the narrow side mold walls can be controlled to an arbitrarily set temperature prior to and during casting.

It is preferable that the heating temperature of the surface of the squeezed portion of each of the narrow side mold walls in contact with the molten metal is controlled to a temperature higher than the liquids temperature of the molten metal.

It is preferable that vibration application means is provided to vibrate the fixed molds in a direction toward which the ingot is drawn.

It is preferable that the narrow side mold walls can be arbitrarily moved in the width direction of an ingot regardless of that casting is carried out or not and that there is provided means for controlling the movement and fixing of the above molds.

It is preferable that rolls or a pair of endless belts are provided to support an ingot coming from the fixed mold to prevent the expansion of the ingot due to the static pressure of molten metal.

It is preferable that back-up rolls are provided in contact with the above rolls to back up the above rolls.

It is preferable that the portion of the narrow side mold walls which is in contact with the wide side mold walls has a dimension (d) of the range ½ times the thickness (t) (including 0) of the ingot in the thickness (t) direction of the ingot and is composed of the same type of the material as that of the wide side mold walls.

It is preferable that the surface of the squeezed portion of each of the narrow side mold walls in contact with molten metal is composed of an electric conductive refractory material which is heated by being energized.

It is preferable that to provide a unit for applying an electromagnetic force to the molten metal in the mold.

According to the present invention, there is provided a continuous casting apparatus for pouring molten metal into the space of a mold formed by wide side mold walls and narrow side mold walls wherein the wide side mold walls are composed of a pair of endless tracks and moved in synchronism with the drawing speed of an ingot, the narrow side mold walls are fixed to the direction toward which the ingot is drawn and the width of each of the narrow side mold walls is narrowed from a molten metal surface toward a casting direction, the continuous casting apparatus comprising control means for effecting control operation so that the squeeze of the molten metal is finished in the state that the molten metal is not solidified on the surfaces of the narrow side mold walls.

According to the present invention, there is provided a thin sheet continuous casting apparatus including a vibration unit foe vibrating a fixed mold composed of narrow side mold walls and wide side mold walls in an ingot drawing direction, which comprises heating means disposed on the surface of each of the narrow side mold walls in contact with molten metal and a vibration unit for causing fine vibration of high cycle in the ingot drawing direction.

According to the present invention, there is provided a thin sheet continuous casting apparatus including a vibration unit for vibrating a fixed mold composed of narrow side mold walls and wide side mold walls in an ingot drawing direction and a twin-belt type mold moving in synchronism with the movement of an ingot or rolls rotating in synchronism with the movement of the ingot, the twin-belt type mold or the rolls being disposed on the downstream side of the fixed mold continuous thereto, which comprises heating means disposed on the surface of each of the narrow side mold walls in contact with molten metal.

Each of the narrow side mold walls of the present invention has a squeezed portion which is squeezed from the upper portion of the narrow side mold wall to the lower portion thereof with a curvature and a parallel portion disposed under the squeezed portion, the squeezed portion has heating means disposed on the surface thereof in contact with molten metal, and the surface of the parallel portion in contact with the molten metal is composed of a water-cooled metal body.

According to the present invention, there is provided a manufacturing system integrated from casting to rolling including a continuous casting apparatus for pouring molten metal into a mold and continuously making an ingot having a desired thickness, a train of multi-stage hot rolling mills for hot rolling the ingot, a cooling unit for cooling a finally-rolled material and a coiler for coiling the rolled and cooled material, wherein the continuous casting apparatus includes a mold formed by confronting wide side mold walls and confronting narrow side mold walls, and each of the narrow side mold walls has heating means disposed on the surface thereof in contact with the molten metal and/or the fixed mold has vibration means for vibrating the fixed mold in an ingot drawing direction, whereby continuous casting and rolling are continuously carried out so that the ingot is rolled by a train of the rolling mills while the temperature of the ingot is uniformly kept in a soaking pit.

The present invention includes a coiler or a soaking pit for coiling or storing the ingot before the ingot is hot rolled, ingot moving means for moving the ingot held by or in the. coiler or the soaking pit onto a train of the rolling mills and casting speed/rolling speed control means for setting a rolling speed converted into a finally-rolled amount of the ingot per unit time higher than a casting speed converted into an amount of the ingot per unit time.

According to the present invention, there is provided a manufacturing system integrated from casting to rolling including two continuous casting apparatuses for pouring molten metal into molds and continuously making ingots having a desired thickness, a train of multi-stage hot rolling mills for hot rolling the ingots, a cooling unit for cooling a finally-rolled material and a coiler for coiling the rolled and cooled material, the integrated manufacturing system comprising two coilers or soaking pits for coiling or storing the ingots obtained from the two continuous casting apparatuses before the ingots are hot rolled, ingot moving means for alternately moving the ingots obtained from the two continuous casting apparatuses onto a train of the rolling mills, and casting speed/rolling speed control means for setting a rolling speed converted into a finally-rolled amount of the ingots per unit time higher than a casting speed converted into an amount of the ingots per unit time.

The present invention includes a coiler for coiling the ingot before the ingot is hot rolled, and ingot moving means for horizontally turning the ingot at least 180° and moving the ingot onto a train of the rolling mills.

The present invention includes a rolling mill for roughly hot rolling the ingot, a coiler for coiling the rough rolled ingot, ingot moving means for moving the rolled and coiled ingots to a train of the rolling mills, and rough rolling/finish rolling speed control means for setting a rolling speed converted into a finally-rolled amount of the ingot per unit time higher than a rolling speed converted into a roughly-rolled amount of the ingot per unit time.

The present invention includes a coiler or a soaking pit for coiling or storing the ingot before the ingot is hot rolled, a fixed mold formed by confronting wide side mold walls and confronting narrow side mold walls and constituting the continuous casting apparatus with the width of each of the narrow side mold walls being narrowed from a molten metal surface toward a casting direction, heating means disposed on the surface of each of the narrow side mold walls in contact with the molten metal and/or vibration means for vibrating the wide side mold walls in an ingot drawing direction, ingot moving means for moving the ingot held by or in the coiler or the soaking pit onto a train of the rolling mills, with the ingot moving means of the coiler having a structure for horizontally turning the ingot at least 180° to a train of the rolling mills, and casting speed/rolling speed control means for setting a rolling speed converted into a finally-rolled amount of the ingot per unit time higher than a casting speed converted into an amount of the ingot per unit time.

According to the present invention, there is provided a manufacturing system integrated from casting to rolling including two continuous casting apparatuses for pouring molten metal into molds and continuously making ingots having a desired thickness, a train of multi-stage hot rolling mills for hot rolling the ingots, a cooling unit for cooling a finally rolled material and a coiler for coiling the rolled and cooled material, the integrated manufacturing system from casting to rolling comprising a fixed mold formed by confronting wide side mold walls and confronting narrow side mold walls constituting each of the continuous casting apparatuses with the width of each of the narrow side mold walls being narrowed from a molten metal surface toward a casting direction, heating means disposed on the surface of each of the narrow side mold walls in contact with the molten metal and/or vibration means for vibrating the wide side mold walls in an ingot drawing direction, ingot moving means for moving the ingots held by or in the coilers or soaking pits onto a train of the rolling mills, the ingot moving means of each of the coilers having a structure for horizontally turning the ingots at least 180° to a train of the rolling mills, two coilers or soaking pits for coiling or storing the ingots obtained from the two continuous casting apparatuses before the ingots are hot rolled, ingot moving means for alternately moving the ingots obtained from the two continuous casting apparatuses onto a train of the rolling mills, and casting speed/rolling speed control means for setting a rolling speed converted into a finally-rolled amount of the ingots per unit time higher than a casting speed converted into an amount of the ingots per unit time.

According to the present invention, there is provided a manufacturing system integrated from casting to rolling including a continuous casting apparatus for pouring molten metal into a mold and continuously making an ingot having a desired thickness, a train of multi-stage stage hot finish rolling mills for hot rolling the ingot, a cooling unit for cooling a finally-rolled material and a coiler for coiling the rolled and cooled material, the integrated manufacturing system from casting to rolling comprising a fixed mold formed by confronting wide side mold walls and confronting narrow side mold walls constituting the continuous casting apparatus, and heating means disposed on the surface of each of the narrow side mold walls in contact with the molten metal and/or vibration means for vibrating the wide side mold walls in an ingot drawing direction, wherein the train of the hot finish rolling rolls include a rolling mill having working rolls indirectly driven by reinforcing rolls or intermediate rolls, the working rolls or the intermediate rolls are provided with a roll bending unit for adjusting the deflection of the rolls to enable a sheet crown to be varied, and the rolling mill having the working rolls driven by the reinforcing rolls or the intermediate rolls is composed of any of:

a four-stage rolling mill having working rolls and reinforcing rolls which are crossed as a pair so that the sheet crown can be varied by changing the profile of a gap between the rolls;

a rolling mill having working rolls or reinforcing rolls or working rolls and reinforcing rolls each applied with a curve which is asymmetric to the pass center of the rolling mill and symmetric to upper and lower lines so that the profile of a gap between the rolls can be changed by moving the rolls in a roll axis direction;

a four-stage rolling mill for dispersing the wear of rolls caused by rolling operation by moving working rolls in a roll axis direction to reduce the change of a roll gap caused by the wear;

a six-stage rolling mill having intermediate rolls moved in a roll axis direction and providing a rolling bending unit with working rolls or the intermediate rolls in addition to the movement so that a sheet crown can be varied by adjusting the deflection of the rolls; and a cluster mill having working rolls each supported by a plurality of reinforcing rolls.

According to the present invention, there is provided a manufacturing system integrated from casting to rolling including a continuous casting apparatus for pouring molten metal into a mold and continuously making an ingot having a desired thickness, a train of multi-stage hot finish rolling mills for hot rolling the ingot, a cooling unit for cooling a finally-rolled material and a coiler for coiling the rolled and cooled material, wherein a thickness of the ingot is 20–70 mm, an ingot drawing speed is 4–15 m/min., a value obtained by multiplying the ingot thickness and the ingot drawing speed is 2500–4000 $cm^2$/min., a rolling speed at the final stage of the finish rolling mills is 250 m/min. or more and the length of the manufacturing line from the center of the continuous casting apparatus to the center of said coiler is 100 m or less.

An ingot has a width of 1.5–2.5 m and carbon metal, stainless metal and the like are made in the manufacturing system integrated from casting to rolling. An ingot having a thickness of 20–40 mm can be made by a manufacturing line as short as 100 m or less (preferably 80–100 m) and an ingot having a thickness of 50–70 mm can be made by a manufacturing line as short as 130–170 m by employing such a manufacturing method that the ingot is subjected to a primary rough rolling and then finish rolled after processed by a recoiler or a soaking pit.

According to the above arrangement, the upper portion of a pouring basin is widened and the lower portion thereof is narrowed. As a result, a molten metal pouring nozzle can be easily inserted at the upper portion as well as a thin ingot is drawn from the outlet of the fixed mold so that such a thin ingot can be made.

Since the narrow side mold walls are heated to a temperature higher than a liquidus temperature, no solidified shell is created on the surface of the narrow side mold walls. Thus, since a process in which the width of the narrow side mold walls is narrowed, which is caused by the shell on the surfaces of the narrow side mold walls, can be avoided, that is, since a drawing resistance is not caused in a squeezing process, casting can be stably carried out at high speed.

Since an ingot is supported by a belt or the like as a secondary cooling body, bulging can be prevented, by which casting can be carried out at high speed.

Further, according to the above arrangement, since an electromagnetic force can be applied to the molten metal in the mold, there is applied a force acting to exfoliate the molten metal in the vicinity of menisci and an initially solidified shell from the mold. Therefore, mold powder can easily flow between the mold and the solidified shell so that break-out is less produced.

Since a resulting ingot is thin, a rolling reduction necessary to finish the ingot to a final thickness can be reduced and thus the number of necessary rolling mills can be reduced.

According to the vibration of the fixed ingot and the heating of the narrow side ingots effected by the present invention, since the upper portion of the narrow side ingots is widened, molten metal can be poured using a dipping nozzle having a conventional size and molten metal on the narrow side mold walls can be easily squeezed. Further, an ingot having a smooth surface can be obtained by the application of fine vibration of high cycle.

Since bulging strain caused to an ingot can be prevented by extending the lower end of the mold to the twin-belt side, casting can be carried out at high speed.

Preferred embodiments of the invention will be described hereinunder with reference to the accompanying drawings.

DESCRIPTION OF PREFERRED EMBODIMENT

Embodiment 1

Figure 1:
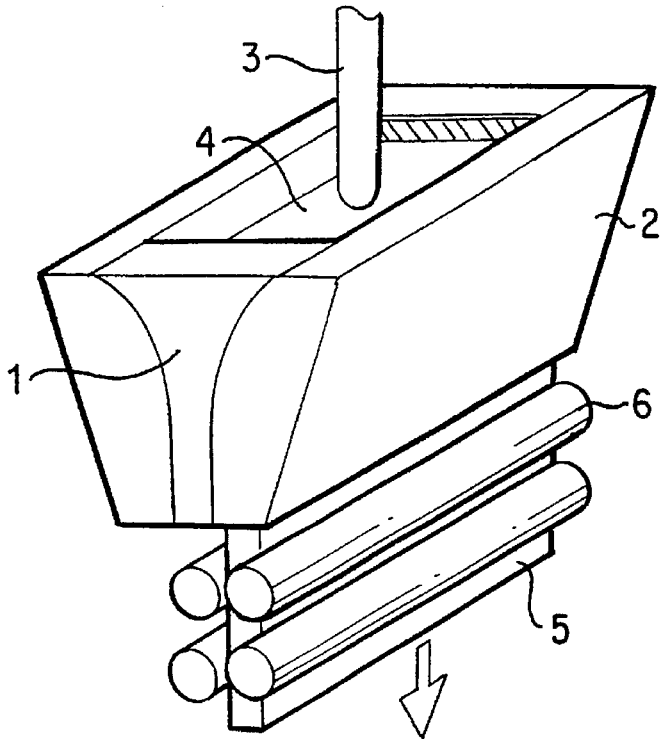
FIG. 1 is a schematic perspective view of a continuous casting apparatus of the present invention.

FIG. 1 is a view schematically showing a mold used in a continuous casting apparatus used in the present invention. Molten metal is poured into a fixed mold composed of fan-shaped narrow side mold walls 1 each having a wide upper portion and a narrow lower portion and wide side mold walls 2 through a molten metal pouring nozzle 3 disposed to a tundish to form a molten metal pool 4. The molten metal is cooled and solidified in the mold, made to a slab ingot 5 and drawn to the lower portion of the mold. At that time, the ingot is supported by support rolls 6. Each of the wide side mold walls 2 is composed of a highly heat insulating refractory material.

Figure 2A:
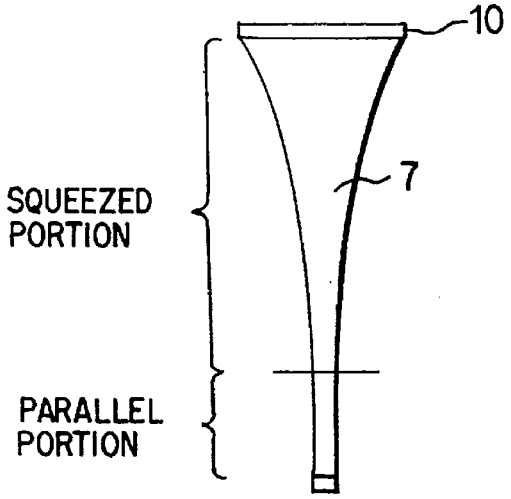
FIGS. 2A and 2B are a cross-sectional view and a plan view of a narrow side mold wall of the present invention.
Figure 2B:
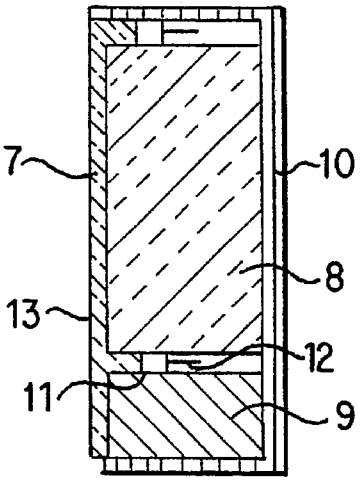

FIG. 2 is a view showing the structure of the narrow side mold walls used in the present invention. An electric conductive refractory material 7 is disposed on the surface of the narrow side mold wall in contact with molten metal, a highly heat insulating refractory material 8 is disposed to a squeezed portion on the backside of the electric conductive refractory material 7 and an inside water cooled type copper plate 9 is disposed to a parallel portion. An electric current flows to the electric conductive refractory material 7 inserted into a frame 10 from conductors 12 through electrodes 11. A thermocouple 13 is mounted to the electric conductive refractory material 7 so that the variation of temperature of the electric conductive refractory material 7 can be measured prior to and during casting. A temperature measured by the thermocouple 13 is input to a control circuit to control the temperature of the electric conductive refractory material 7 to a predetermined value. In FIG. 2, (*a*) is a front view of the narrow side mold wall and (*b*) is a side view of the narrow side mold wall. In FIG. 2 (*a*), the squeezed portion is squeezed to an are shape and then the parallel portion is formed. The length of the parallel portion is walls 200–1000 mm and preferably 300–500 mm and the length of the squeezed portion is 300–1000 mm and preferably 400–600 mm. The parallel portion has a length 0.4–0.5 times that of the length of the overall mold and the squeezed portion has a radius of curvature of 1500–5000 mm (preferably 2500–3500 mm). It is preferable that the upper portion of the mold has a width 1.5–4 times (preferably 1.9–2.5 times) the thickness of an ingot or the size of the enlarged upper portion of the mold is 0.1–0.35 times (preferably 0.1–0.31 times) the length of the squeezed portion on the both sides thereof.

The wide side mold wall is composed of a Cu alloy having large strength or hardness and containing one or more kinds of Zr, Cr, Ti, Hf, V etc. in an amount of 5 wt % or less (preferable 1–3 wt %) with a penetration preventing plated layer of Ni, Cr etc. formed to at least the surface thereof in contact with molten metal.

The narrow side mold wall has the structure shown in FIG. 2 (*b*), the electric conductive material 7 is composed of a sintered body made by the mixture of alumina powder, graphite fibers, carbon fibers, electric conductive ceramics powder etc., the refractory material 8 is composed of ceramics sintered body having high insulating property such as alumina, fused silica etc., and the frame is composed of carbon metal. The electric conductive refractory material 7 is disposed to cover the copper sheet 9 so that there is no boundary therebetween. Further, the narrow side mold wall 7 is formed to an arc shape. As described above, since the portion of the narrow side mold wall 7 in contact with molten metal is heated to high temperature by being energized, the thickness of the narrow side mold wall is made thin at the upper portion thereof and thick at the lower portion thereof to obtain a uniform electric resistance or the content of an electric conductive material is decreased at the upper portion of the mold and increased at the lower portion thereof so that the overall mold can be uniformly heated. It is preferable that the content of the electric conductive material is adjusted to 15 wt % or less (preferably 5–15 wt %).

A result of simulation of casting carried out by the aforesaid apparatus will be described below.

An ingot was 30–70 mm thick and 1000–2100 mm wide and the narrow side mold walls were preheated for about 10 minutes prior to the start of the casting. Although the surface of the electric conductive refractory material 7 constituting the narrow side mold wall 1 had a temperature distribution, the electric conductive refractory material was at 1520° C. at the center in the width direction thereof and at 900° C. in the vicinity of the wide side mold wall.

Figure 3A:
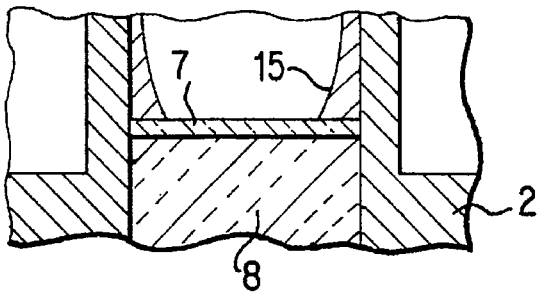
FIGS. 3A–3C illustrate the progress of solidification in a mold.
Figure 3B:
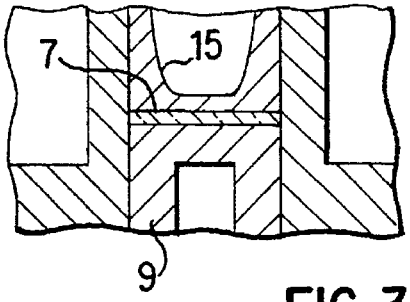
Figure 3C:
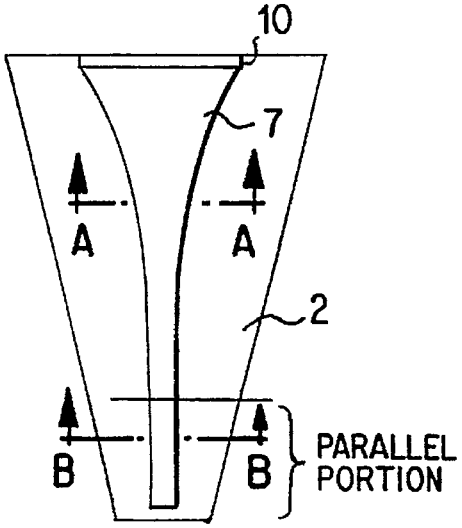

FIG. 3 shows the solidified state in the mold when carbon metal (carbon content: 0.05%) was cast at a casting speed of 10 m/min. FIG. 3 (*a*) shows a squeezing process (cross section A—A), in which since the narrow side mold walls 1 are heated to high temperature, no solidified shell is formed to narrow side surfaces. Thus, no drawing resistance is caused by the squeezing at the narrow sides. Since the narrow side mold walls 1 are cooled by the water-cooled copper sheet 9 in the region where the squeezing has been finished (in the parallel portion), solidified shells 15 are grown on the narrow side surfaces. As described above, according to the present invention, since squeezing can be naturally finished by preventing the growth of solidified shells on the narrow side surfaces and shells are grown on the narrow side surfaces by cooling them after the completion of the squeezing, a thin ingot can be continuously made.

In this embodiment, although an ingot 5 is continuously cast so that the solidification thereof is not completed in the mold, the ingot 5 is drawn out by the rolls 6 as shown in FIG. 1 as well as cooled over a plurality of rows on the both sides thereof at the time just after the ingot comes from the mold and between the rolls 6 by a mixed jet flow of air and water. Although the casting is perpendicularly carried out, it is guided to a horizontal direction by the provision of a plurality of rows (preferably 5–10 rows) of the rolls 6. Each of the rolls 6 is composed of heat resistant metal and the inside thereof is cooled by water.

In this embodiment, the mold is vibrated in a vertical direction with a total amplitude of 20 mm or less (preferably 3–15 mm) and the number of vibration of 3–100 Hz (preferably 5–20 Hz). The amplitude and the number of vibration are particularly related to a casting speed. As a casting speed is more increased, an ingot is made thinner and similarly as an ingot is made thinner, the casting speed is increased. The above amplitude is suitably combined with the above number of vibration so that the casting speed is set to 4–5 m/min with respect to an ingot of 70 mm thick, 5.5–7 m/min. with respect to an ingot of 50 mm thick, and 12.5–15 m/min with respect to an ingot of 20 mm thick.

When continuous casting is carried out, molten metal is poured into the mold as well as mold powder is added and floats on the surface of a molten metal surface. The mold powder is very fine powder having a diameter of 100 μm or less (preferably 5–50 μm) and has an effect of keeping the temperature of the molten metal surface and an action of reacting with non-metallic inclusion floating on the molten metal surface and absorbing the inclusion to remove the inclusion from the molten metal so that an ingot containing a less amount of inclusion can be obtained. The mold powder is composed of a component having a flux action such as CaO, $CaF_2$, $SiO_2$, MnO etc.

Figure 4:
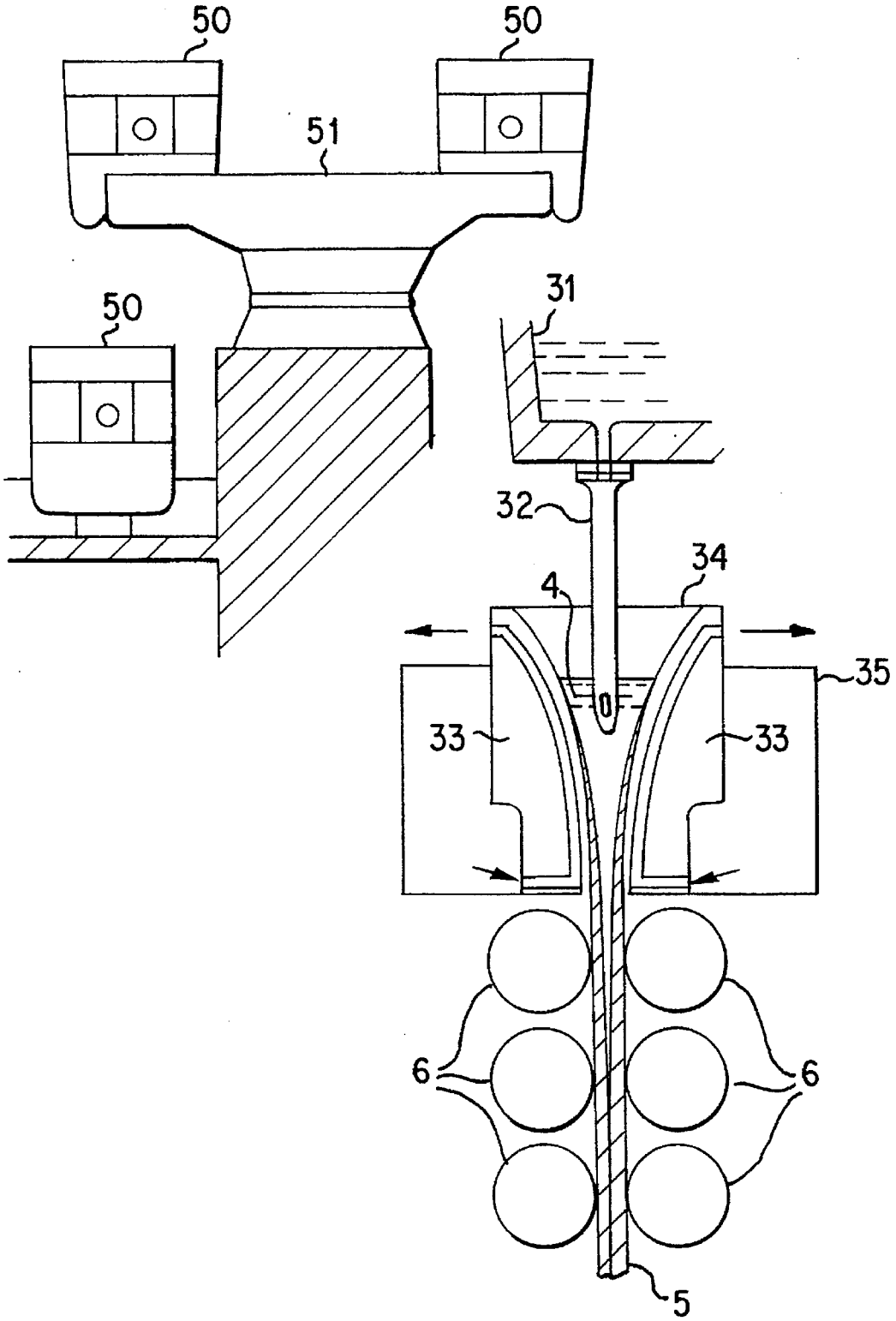
FIG. 4 is a cross-sectional view of a continuous casting apparatus of the present invention.
Figure 5:
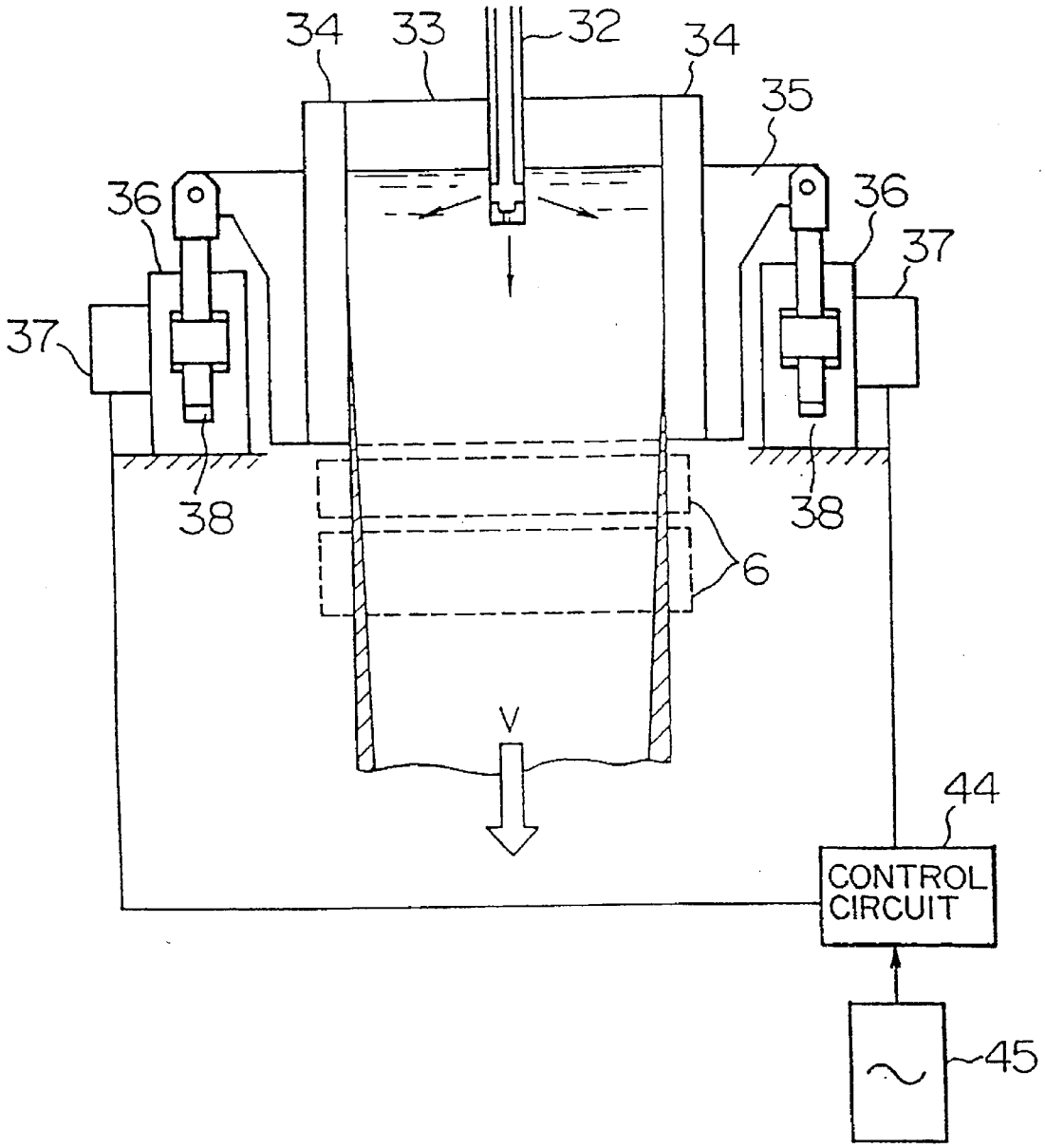
FIG. 5 is a cross-sectional view of the continuous casting apparatus of the present invention.
Figure 6:
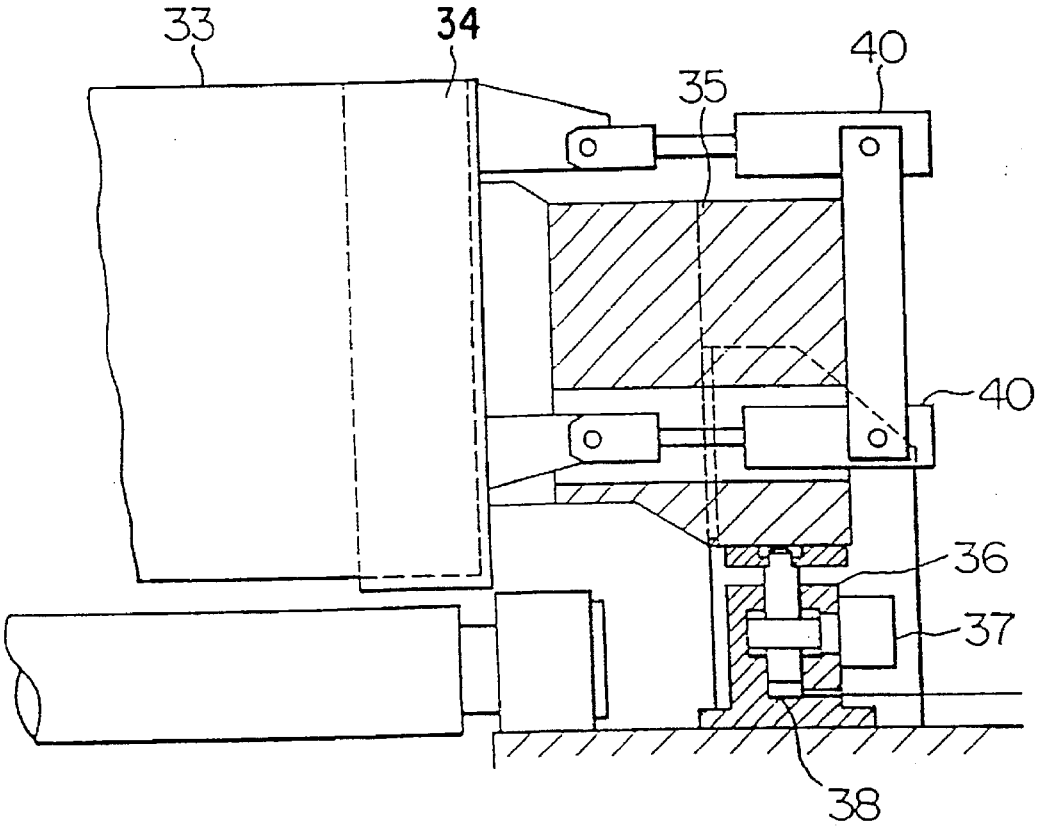
FIG. 6 is a cross-sectional view of the continuous casting apparatus of the present invention.

FIG. 4–FIG. 6 are cross sectional views showing a vibration unit of the mold.

Molten metal in a tundish 31 is poured into a mold from a submerged nozzle 32. The flow amount the molten metal is controlled to keep the height of the molten metal substantially to a predetermined height. The molten metal is poured into the tundish through a ladle 50. The ladle 50 is mounted on an arm 51 capable of horizontally rotating at least 180° and at least two ladles 50 are mounted thereon. When one of the ladles is in casting operation, the other ladle is in a waiting state and the when the former ladle finishes casting, the latter ladle is rotated simultaneously with the former one and replaced with the former one to carry out casting. The ladle 50 having finished casting is returned to its original position, replaced with the ladle 50 filled with molten metal and then waits. This process is repeated to carry out continuous casting.

A mold is composed of a fan-shaped narrow side mold walls 34 and wide side mold walls 33. The narrow side molds 34 have the aforesaid shape and composed of an electric conductive refractory material and insulating ceramics to prevent the solidification on the narrow side squeezed portions with the parallel portions thereof each composed of a water-cooled copper sheet 9 to promote solidification thereon. Further, the backside of the narrow side mold wall 34 is composed of a carbon metal frame for suppressing the thermal deformation of the water-cooled copper sheet 9. The parallel portion is composed of the water-cooled copper sheet to form the solidified shells on the narrow side mold walls after squeezing.

On the other hand, the ingot side of the wide side mold wall 33 is composed of the arc-shaped water-cooled copper sheet as described above and a solidifying shell is formed from a molten metal surface.

The narrow side mold walls 34 and the wide side mold walls 33 are accommodated in a mold outside frame 35 and the both sides of the mold outside frame 35 are supported by vibration cylinders 36, respectively so that the frame 35 can be vibrated in an ingot drawing direction at the aforesaid number of vibration and amplitude.

A desired waveform (e.g., sine wave, triangular wave or the like) is input to an electro-hydraulic servo valve 37 mounted on each of the vibration cylinders 36 from a high cycle vibration indicator 45 and the vibration cylinders 36 on the right and left sides are vibrated in synchronism with each other by a synchronous control circuit 44.

Note, numeral 38 denotes a balance cylinder into which a predetermined pressure is given so that the balance cylinder 38 balances with the vibrating weight mainly resulting from the mold by making use of the lower rods of the vibration cylinders 36.

Numeral 40 denotes width changing cylinders.

According to the aforesaid arrangement, since the molten metal is vertically supported until the completion of solidification thereof, there can be obtained an effect of causing the inclusion in the molten metal to float, so that this arrangement is suitable for kinds of metal to which high internal quality is required.

The features of the Casting apparatus of this embodiment by which a thin sheet can be stably cast at high speed and an ingot of high quality can be obtained are summarized as follows.

(1) The fixed mold with the narrow sides thereof squeezed to enlarge the mold upper portions is employed. The surface of the narrow side upper squeezed portion is composed of the electric conductive refractory material to prevent the formation of a solidified shell.

(2) The fixed mold is vibrated at high cycle in an ingot drawing direction as described above.

(3) The feed of an ingot effected by the rolls following the fixed mold and secondary cooling are synchronized with the ingot so that the ingot on the wide side mold walls is stably supported by bulging.

The function and feature of the respective portions will be described below.

(1) Molten metal can be poured from the tundish into the mold by a submerged nozzle having a conventional size due to the employment of the narrow-side-squeezed mold with the enlarged mold upper portion.

(2) The narrow-side-squeezed portion is composed of the refractory material so that the molten metal on this portion can be easily squeezed without being solidified. The narrow side straight portion following the narrow-side-squeezed portion is composed of the copper sheet whose inside is cooled by water to solidify the ingot on the narrow sides after the ingot is squeezed.

The edge of refractory material constituting the squeezed portion is covered with a water-cooled copper sheet to prevent the damage of the edge. The wide sides are composed of the copper sheet whose inside is cooled by water and which is curved along the squeezed shape of the narrow sides to form shells on the wide sides.

(3) The wide side mold walls and the narrow side mold walls are integrally supported by the mold outside frame to make an ingot having a smooth surface by vibrating the mold at high cycle.

(4) The feed rolls following the squeezed mold is rotated in synchronism with an ingot drawing speed and has a function for continuously suppressing bulging caused by secondary cooling and the static pressure of molten metal in the section until the ingot is completely solidified and completely preventing the occurrence of the bulging.

Figure 7:
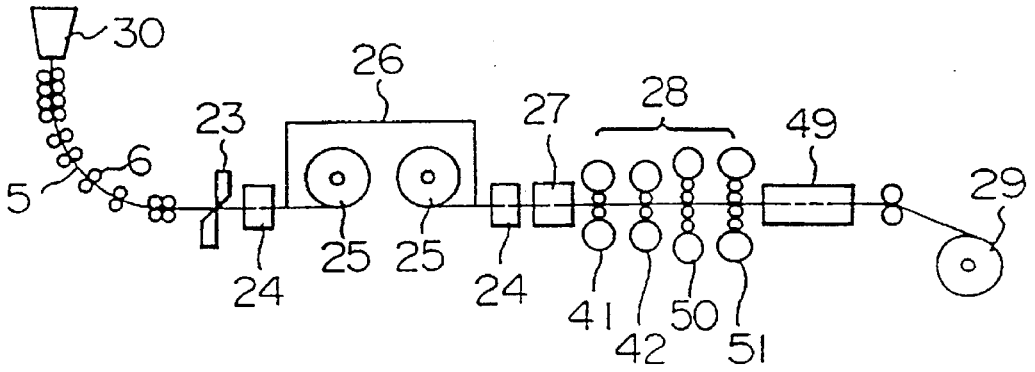
FIG. 7 is a view showing the arrangement of an integrated manufacturing system of the present invention including the continuous casting apparatus and a train of rolling mills.

FIG. 7 schematically shows a rolling mill system used in this embodiment. A slab ingot 5 having a thickness of 300 mm and made by a continuous casting apparatus 30 is bent and corrected while being supported by support rolls 6 and fed out in a horizontal direction. The slab ingot 5 is heated to a hot rolling temperature (preferably 1000°–1100° C.) in a heating furnace and wound as an ingot coil 25. The temperature of the ingot coil 25 is kept in a temperature insulation box 26. When the weight of the ingot coil 25 reaches a predetermined weight, it is cropped by a shearing machine 23. The wound slab ingot 5 is heated to a predetermined temperature when it passes through the heating furnace 24 and rolled by a train of the four hot rolling mills 28 after the oxide film thereof is removed by a scale removing unit 27 to obtain a metal band at 800°–900° C. Next, the metal band is cooled to 500°–600° C. by a cooling unit 49 to make a hot-rolled coil 29. Since a rough roll mill is not used in this embodiment and the hot-rolled coil 29 can be made by the four finishing roll mills, the length of the rolling line can be shortened to 150 m or less.

(1) This embodiment is arranged such that the ingot 5 made by the continuous casting apparatus 30 is wound from the downstream side thereof to obtain the ingot coil 25, which is horizontally turned 180° by a turning unit in the wound state, so that the ingot is also fed to the rolling mills from the downstream side thereof when it is rolled. When the ingot is wound to an upper side, it is fed from the upstream side to the rolling mills. Since a line along which the ingot flows is turned 180° about an axis, the position of the line set after it is turned is different from a rolling line.

(2) Although the ingot coil 25 to be fed to the rolling mills is disposed in a straight line with a train of the rolling mills 28, the continuous casting apparatus 30 is disposed in a straight line with the rolling mills when the aforesaid ingot coil 25 is turned 180°. Therefore, to further increase a casting speed, two set of the continuous casting apparatuses 30 may be disposed at the positions obtained by turning them 180° with respect to the ingot coil 25 to be fed to the aforesaid rolling mills on the right and left sides of the ingot coil 25.

(3) Carbon metal, austenitic stainless metal, ferrite stainless metal etc. can be integrally made by the embodiment.

According to prior art, since a rough rolling process is needed, a length of at least about 400 m is required from a continuous casting apparatus to a winder. According to the present invention, however, the rough rolling process can be omitted, and when it is omitted, an entire line may be greatly shorted to a length of 70–150 m and more preferably to 70–90 m.

In the illustrated hot rolling equipment, a slab of about 30 mm thick supplied from the continuous casting apparatuses 30 is fed to table rollers 6 and made to a bar member of about 30 mm thick while a sheet width is adjusted by edgers 24 in front of and behind the coils 25. Then, the coil 25 is fed to a train of the finishing rolling mills 28 after the oxide scale deposited on the surface thereof is removed by a scale removing unit 27.

Two-stage or four-stage rolling mills 41, 42 may be disposed to the train of the finish rolling mills 28 as front rolling mills, each of the rolling mills 41, 42 includes directly-driven working rolls of a large diameter in order to secure the biting capability of front stage rolling mills.

Although two sets of the four-stage rolling mills 41, 42 are disposed in the embodiment by way of example, one set of the four-stage rolling mill including directly-driven working rolls having a large diameter may be used.

Six-stage rolling mills 50, 51 each having working rolls of a small diameter which are driven by reinforcing rolls or intermediate rolls are disposed to the intermediate stage and rear stage of the train of the finish rolling mills 28. A bar member is strongly rolled by the rolling mills 50, 51 at low speed.

When the finish rolling mill is a 4 feet mill (for rolling a member to be rolled to a width of 4 feet), the finish rolling mill is composed of a four- or six-stage mill including working rolls having a small diameter of about 300–400 mm and driven by intermediate rolls.

The strip having been subjected to finish rolling is cooled with water by a cooling unit 49 and wound to a winder 29 by a chain type belt trapper through pinch rollers and transported by a coil car after the completion of the winding.

In the above embodiment, although the diameter of the working roll of the rolling mill is referred to as the large diameter and the small diameter, a large diameter working roll usually has a diameter of 600–900 mm. In this embodiment, however, a working roll having a diameter of 450 mm or more is called a large diameter working roll (this is also applied to the following embodiments).

Further, the small diameter roll is a roll having a diameter which cannot directly drive a working roll as described above, and, for example, the small diameter roll is a roll having a diameter by which a ratio D/B of about 0.3 or less is achieved, where D is a diameter of a working roll and B is a rolling torque.

In this embodiment, a roll having a diameter of 450 mm or less is called a small diameter roll (this is also applied to the following embodiments).

A composite roll is preferably used as the working roll of this embodiment. In particular, preferable is a working roll having an integral composite structure formed by an outer layer, which is composed of high speed metal containing C: 0.5–1.5%, Si: 3.0% or less, Mn: 1.5% or less, Cr: 2–15%, Mo: 10% or less, W: 20% or less, V: 1–5%, Co: 5–15% each in terms of weight and the remaining substantially Fe, and a shaft member, which is composed of cast metal or forged metal having a tensile strength of 55 kg/mm$^2$ or more, with the outer layer being particularly formed by electro-glass melting. To secure wear resistance and surface roughness resistance, it is necessary that the outer layer is composed of high speed metal and subjected to a heat treatment so that the outer layer has a hardness of HS80 or more.

C is necessary to form carbon to improve wear resistance and to secure the hardness of the base. When the content of C less than 0.5%, an amount of carbon is insufficient for the improvement of the wear resistance, whereas when the content exceeds 1.5%, an amount of mesh-shaped carbon precipitating to a grain boundary is increased to deteriorate the surface roughness resistance and toughness. Thus, the content of C is preferably 0.7–1.2%.

Si is an element necessary to remove oxygen and also increases a temper resistance. When the content of Si exceeds 3.0%, however, brittleness is liable to be caused. Thus, the content of Si is preferably 0.5–1.0%.

Although Mn has an oxygen removing action and an action for fixing S which is impurity as MnS, when its content exceeds 1.5%, remaining austenite increases, a sufficient hardness cannot be stably kept and tenacity is reduced. Thus, the content of Mn is preferably 0.2–1.0%.

When the content of Cr is less than 2%, a hardening property is deteriorated, whereas when its content exceeds 15%, Cr carbon of relatively low hardness excessively exists to reduce wear resistance. Further, heat crack resistance is also deteriorated. Thus, the content of Cr is preferably 3–8%.

Mo and W are combined with C, respectively to create $M_2C$ carbon or $M_6C$ carbon and dissolved in the base to strengthen the base and increase wear resistance as well as improve temper softening resistance. When Mo and W are excessively contained, however, $M_6C$ carbon increases to reduce tenancy and surface roughness resistance. Thus, the upper limits of Mo and W is 10% and 20%, respectively and it is preferable that 2 Mo+W is 20% or less. Mo is preferably 5–10% and W is preferably 0.5–3%.

V contributes to improve wear resistance by forming MC carbon. When the content of V is less than 1%, however, V does not act effectively, whereas when its content exceeds 5%, grindability is greatly injured. Thus, the content of V is preferably 1–3%.

Co is an effective element for increasing temper softening resistance by forming solid solutions with the base, as well as obtaining increased hardness resulting from high temperature tempering effected by secondary hardening. When the content of Co is less than 5%, however, the effect is limited, whereas when the content exceeds 15%, tenacity is reduced. Thus, the content of Co is preferably 6–9%. Further, Ni may be contained in 5% or less.

A method of manufacturing the composite roll according to the embodiment is such that a cylindrical consumable electrode composed of high speed metal is inserted into a cavity formed between a shaft member and a cooling mold disposed coaxially with the shaft member, the consumable electrode is dissolved by an electro-slag redissolving method in a slag bath while synchronously rotating the shaft member and the cooling mold in a circumferential direction, and an outer layer formed by molten metal which comes into contact with the cooling mold and is solidified is deposited on the shaft member. With this method, the outer layer material is composed of the structure of columnar crystal grown substantially perpendicularly to an axial direction so that high wear resistance can be obtained. The composite roll of the embodiment is composed of a barrel on which the aforesaid outer layer is formed and the bearing potion of the roll is composed of the shaft member. Note, although the composite roll is used as the working roll in the embodiment, a similar composite roll may used as a reinforcing roll, intermediate roll and back-up roll, and an outer layer material used for these rolls has a hardness lower than that of the outer layer used for the working roll.

Embodiment 2

Figure 8:
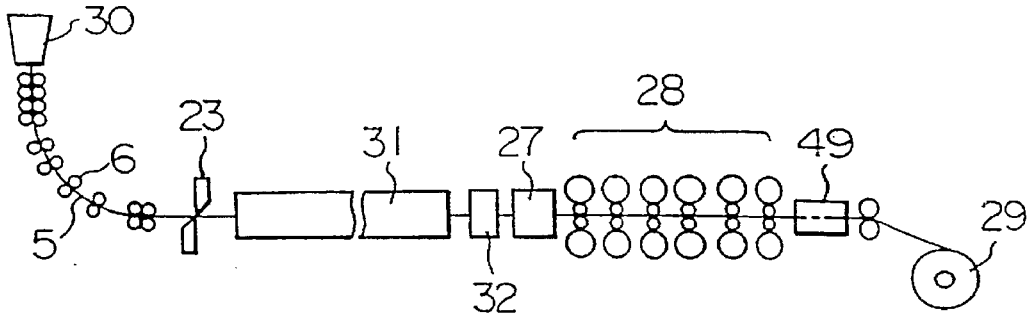
FIG. 8 is a view showing the arrangement of an integrated manufacturing system of the present invention including the continuous casting apparatus and a train of rolling mills.

FIG. 8 is a schematic view of a rolling mill system for directly rolling an ingot 5 of 50–70 mm thick coming from a continuous casting apparatus 30 using a mold shown in the embodiment 1. The slab ingot 5 made by the continuous casting apparatus 30 with an ingot thickness set to 60 mm is bent and then corrected while being supported by support rolls 6 and fed out in a horizontal direction. The slab ingot 5 is cropped by a shearing machine 23 when it is cast to a predetermined length. The heat of the cropped slab ingot 5 is compensated in a soaking pit 31 and the temperature of the entire region of the ingot is uniformly kept. The slab ingot 5 coming from the soaking pit 31 is formed to a predetermined width by a width rolling mill 32 and rolled by six-stand hot rolling mills 28 after the oxide film on the surface of the slab ingot 5 is removed by a scale removing unit 27. A hot-rolled coil 29 is made by the above process. According to this embodiment, since the hot-rolled coil 29 can be made by the six-stand finish rolling mills without the need of a rough rolling mill, the length of a rolling line can be shortened to 180–300 mm. The slab ingot can be rolled up to 1–3 mm in the embodiment similarly to the embodiment 1.

With respect to the hot rolling equipment described in FIG. 7, it is possible that each of the rolling mills 41, 42 disposed on the front stage of the finishing rolling mills. 28 is provided with large diameter working rolls which are driven by reinforcing rolls or intermediate rolls so that the biting capability of the rolling mills on the front stage can be secured.

With respect to the hot rolling equipment described in FIG. 7, it is possible that each of the rolling mills 41, 42 disposed on the front stage of the finishing rolling mills 28 is composed of a two-stage rolling mill provided with large diameter working rolls which are directly driven with the upper and lower working rolls being crossed each other.

(1) In addition to the disclosure of the embodiment, it is possible that the soaking pit 31 holds the ingot 5 cropped by the shearing machine 23 as well as an ingot moving unit is provided to dispose the ingot 5 in the straight line with a train of the rolling mills 28 so that the cropped ingot 5 can be fed to a train of the rolling mills and another ingot 5 is made by the continuous casting apparatus before the rolling of the above ingot 5 is finished and continuously held by soaking pit. As a result, the ingots can be successively rolled by the aid of the ingot moving unit. In this embodiment, rolling operation is successively effected while the ingots are stored in the soaking pit.

(2) In addition to the disclosure of the embodiment, it is also possible that an ingot is directly and roughly rolled to an ingot coil of 30–40 mm thick and then fed to the finishing rolling mills by being horizontally turned 180° similarly to the method described in the embodiment 1. When the ingot is subjected to the rough rolling, the train of the rolling mills may be composed of 4–5 stand tandem roll mills.

(3) There is also a method of rough rolling an ingot through the soaking pit and then the ingot is subjected to the finish rolling of the paragraph (2).

Embodiment 3

It is proposed that in the embodiment described in FIG. 7, six-stage rolling mills each having an intermediate roll shift are used in place of the rolling mills 43, 44 disposed in a train of the finish rolling mills 28.

Figure 9:
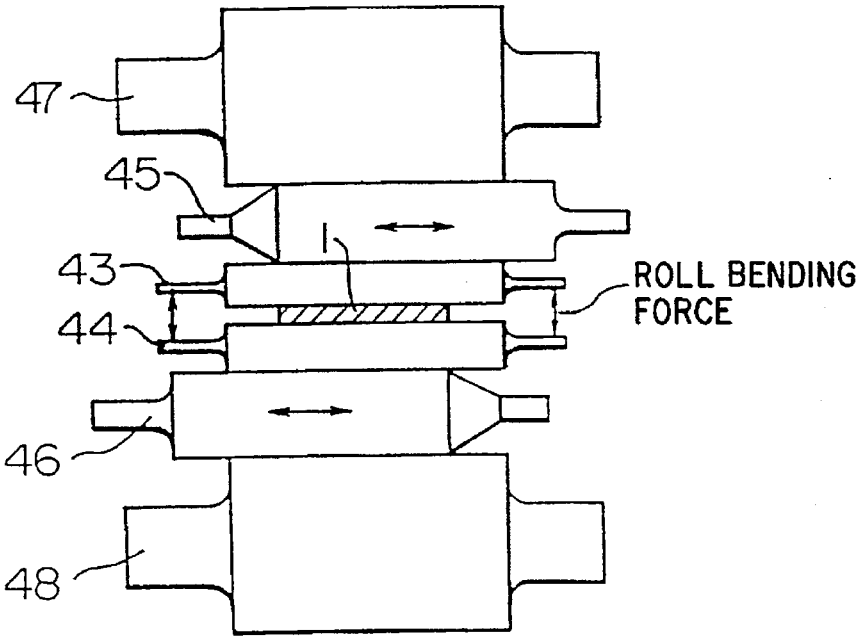
FIG. 9 is a view showing a roll arrangement of a rolling mill according to the present invention.

A rolling mill shown in FIG. 9 includes a pair of upper and lower working rolls 53, 54, a pair of upper and lower intermediate rolls 55, 56 which are movable in an axial direction, and a pair of upper and lower reinforcing rolls 47, 48 to control the distribution of sheet thickness in a sheet width direction by using the movement of the intermediate rolls 45, 46 and the bending of the working rolls 43, 44 in combination to thereby control the crown and shape (flatness) of a sheet. In this type of the rolling mill, the intermediate rolls 45, 46 are moved in the axial direction and supported by the reinforcing rolls 47, 48, respectively.

Note, this type of the rolling mill need not be the type of moving the intermediate rolls in the axial direction but may be a type in which the working rolls are moved in the axial direction or the reinforcing rolls are moved in the axial direction.

Further, a method of crossing rolls in a four-stage rolling mill is widely used in hot rolling. These methods are also effective to solve the aforesaid second problem and can be realized by employing a drive system by reinforcing rolls. This type of the rolling mill includes the one shown in FIG. 10.

Figure 10:
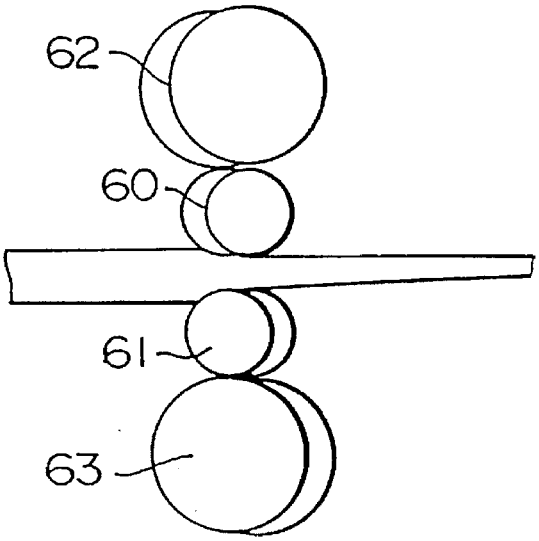
FIG. 10 is a view showing a roll arrangement of the rolling mill according to the present invention.

The rolling mill of the type shown in FIG. 10 is a so-called PC mill including a pair of working rolls 60, 61 and a pair of reinforcing rolls 62, 63, respectively A pair of the working rolls 60, 61 and a pair of the reinforcing rolls 62, 63 supporting the working rolls are crossed each other in a horizontal plane to control the distribution of sheet thickness in a sheet width direction of a rolled material. In the embodiment described in FIG. 7, it is contemplated that the above type of the rolling mill is applicable to the rolling mills 50, 51 disposed to the finish rolling mills 28.

Figure 11:
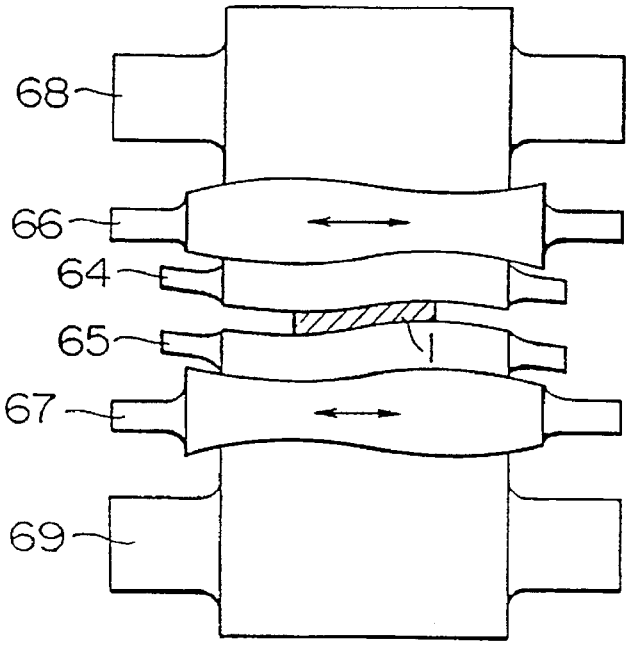
FIG. 11 is a view showing a roll arrangement of the rolling mill according to the present invention.
Figure 12:
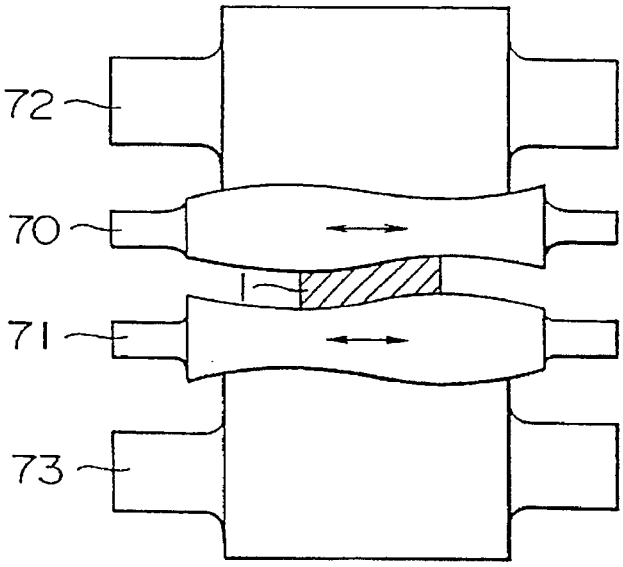
FIG. 12 is a view showing a roll arrangement of the rolling mill according to the present invention.

Further, as shown in FIG. 11 and FIG. 12, there is recently developed a rolling mill having gourd-type crown rolls and this type of the rolling mill can be also effectively used. FIG. 11 and FIG. 12 show the rolling mills having such irregular-shaped rolls. The rolling mill shown in FIG. 11 includes a pair of upper and lower working rolls 64, 65, a pair of upper and lower intermediate rolls 66, 67 and a pair of upper and lower reinforcing rolls 68, 69. The intermediate rolls 66, 67 have gourd-type crown shapes which are symmetrical with respect to a point each other and are movable in a roll axis direction. The distribution of sheet thickness in a sheet width direction is controlled by moving a pair of the intermediate rolls 66, 67 in a reverse direction each other.

Further, the rolling mill shown in FIG. 12 includes a pair of upper and lower working rolls 70, 71 and a pair of upper and lower reinforcing rolls 72, 73. The working rolls 70, 71 have gourd-type crown shapes which are symmetrical with respect to a point each other and are movable in a roll axis direction. The distribution of sheet thickness in a sheet width direction is controlled by moving a pair of the working rolls 70, 717 in a reverse direction each other. These rolling mills having the irregular-shaped rolls have a function for concentrically correcting the shape of sheet edges by moving the gourd-type crowns in an axial direction.

Further, in addition to the above, a four-stage rolling mill has the same effect in which the wear of rolls caused by rolling is dispersed by moving working rolls in a roll axis direction by a shift unit so that the variation of a roll gap caused by the wear can be reduced. Note, reinforcing rolls are driven by a not shown motor through spindles.

Further, a cluster mill of a type in which a pair of working rolls are supported by a plurality of reinforcing rolls also has the same effect.

Further, the same rolling mills as those shown in FIG. 9–FIG. 12 may be used as multi-stand rolling mills in the train of the rolling mills shown in FIG. 8 or the combination of the aforesaid rolling mills may be used as multi-stage rolling mills in FIG. 7 and FIG. 8.

Further, the trains of the rolling mills 28 shown in FIG. 7 and FIG. 8 may be replaced with rolling mills each including upper and lower working rolls having a different roll diameter, reinforcing rolls for the working rolls and an intermediate roll disposed on the side of the smaller diameter working roll so that rolling is carried out by applying a horizontal bending force to the intermediate roll.

Each of the above reinforcing rolls and intermediate rolls may be composed of a composite roll having a core member and an outer layer deposited thereon by electro-slag welding in the same way as the working rolls, the material of the outer layer having a hardness higher than that of the core member.

Embodiment 4

Figure 13:
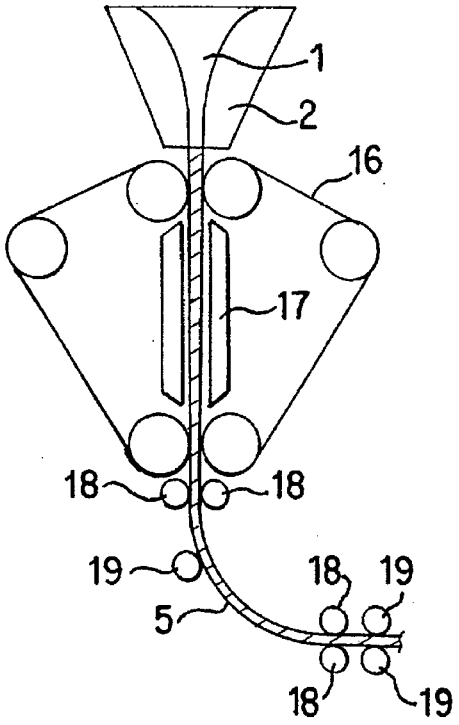
FIG. 13 is a diagrammatic illustration of a continuous casting apparatus used in an embodiment 4 of the present invention.

FIG. 13 schematically shows a continuous casting apparatus used in the embodiment. A fixed mold is composed of narrow side mold walls 1 each having a wide upper portion and a narrow lower portion and wide side mold walls 2 in the same way as the embodiment 1. A slab ingot 5 drawn from the lower end of the fixed mold is supported by a belt 16 moving in synchronism with the ingot and cooled at the same time. The belt 16 is cooled with high pressure water ejected from a cooling pad 17 disposed on the backside thereof. The slab ingot 5 drawn out from the lower end of the belt 16 is bent and then corrected by pinch rolls 18 and a bending roll 19 and fed in a horizontal direction. Since a so-called secondary cooling system following the fixed mold is arranged by an endless track such as the belt or the like as in the present invention, the ingot is continuously supported and thus no problem arises with respect to bulging.

Embodiment 5

Figure 14A:
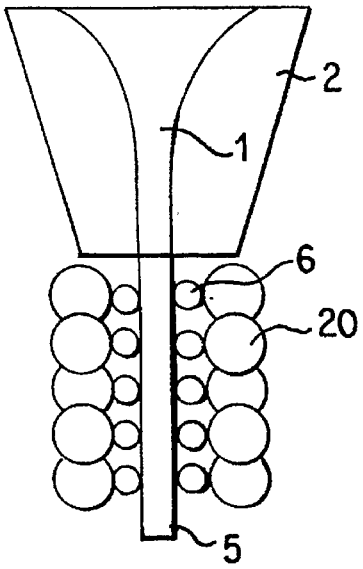
FIGS. 14A and 14B schematically illustrate a continuous casting apparatus used in an embodiment 5 of the present invention.
Figure 14B:
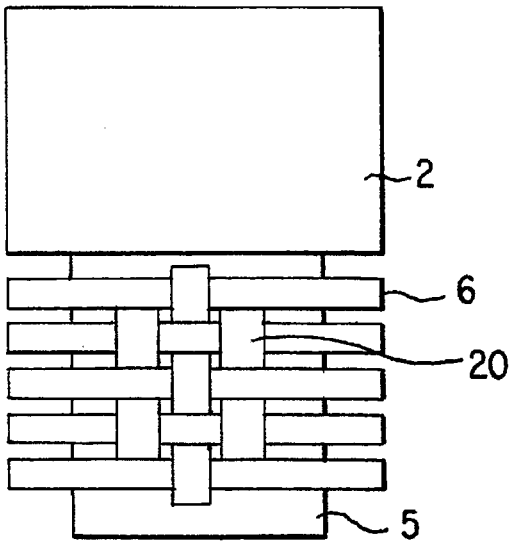

FIG. 14 schematically shows a continuous casting apparatus used in the embodiment. A casting apparatus and a rolling system are arranged substantially the same as those of the embodiment 1 and an ingot coming from a fixed mold is supported by support rolls 6. Further, in this embodiment, the support rolls 6 are supported by back-up rolls 20.

Figure 15:
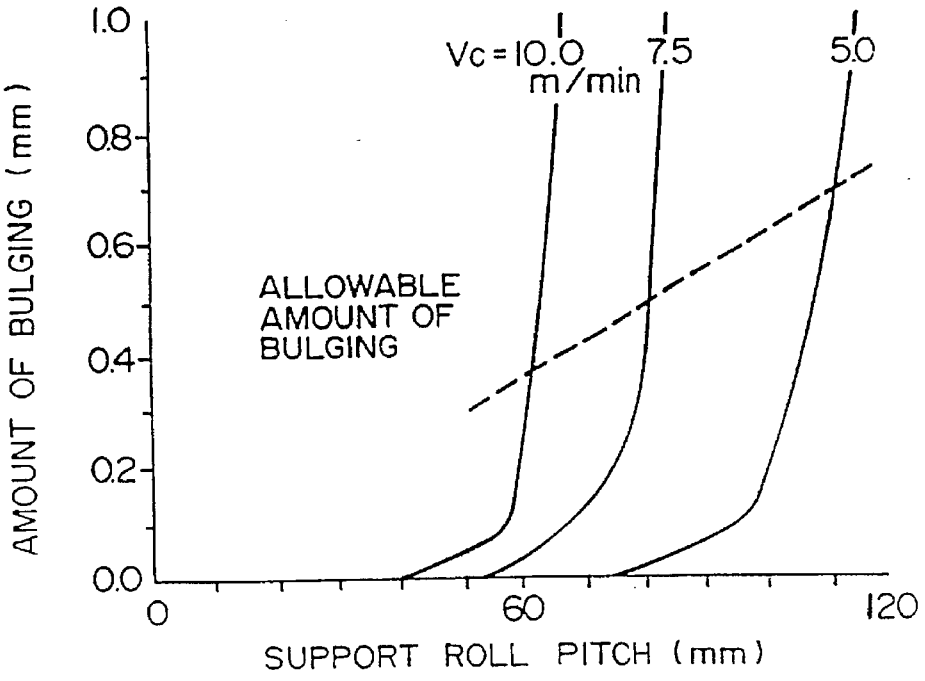
FIG. 15 is a graph showing the relationship between a support roll pitch and an amount of bulging.

FIG. 15 shows the relationship between a support roll pitch and an amount of bulging. A dotted line in FIG. 15 shows an allowable amount of bulging by which inner crack is not caused. The larger is the support roll pitch, the larger amount of bulging is produced. Further, the higher is a casting speed, the thinner a solidified shell becomes, and thus a larger amount of bulging is produced even at the same support roll pitch. Therefore, as the casting speed is higher, the support roll pitch must be more reduced. Although the diameter of support rolls must be reduced to reduce the support roll pitch, there arises in this case a problem that the support rolls are bent and the like. However, the bending of the support rolls can be controlled by supporting them by back-up rolls as in the present invention. Consequently, the support roll pitch can be reduced as well as high speed casting can be realized. Further, according to the technology, since various cooling conditions can be set by employing mist cooling and the like, a wider range of cooling control can be realized as compared with the case in which an endless track such as a belt or the like is employed. The diameter of rolls to be used is 60 mm at 10 m/min, 80 mm at 7.5 m/min. and 100 mm or less at 5 m/min. It is preferable that the rolls have a diameter of at least 40 mm or more.

Embodiment 6

Figure 16A:
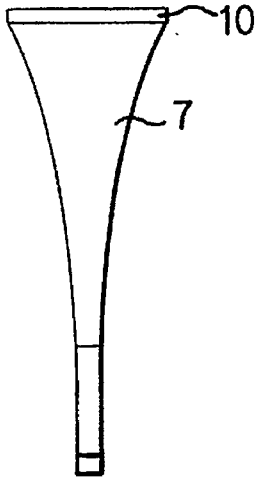
FIGS. 16A and 16B show the structure of a narrow side mold wall used in an embodiment 6 of the present invention.
Figure 16B:
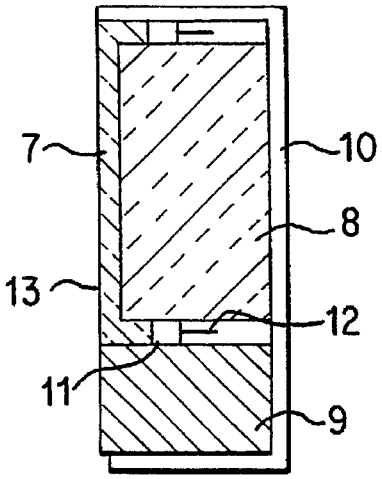

FIG. 16 is a view showing the structure of a narrow side mold wall of the continuous casting apparatus used in this embodiment. Although the mold is arranged substantially similarly to that of the embodiment 1, a water-cooled copper sheet 9 is exposed to the parallel portion (lower portion) of the narrow side mold wall 1 in contact with molten metal. The surface of the water-cooled copper sheet 9 in contact with the molten metal is composed of a Ni plated lower layer and a Cr plated surface layer. FIG. 16 (*a*) is a front view and FIG. 16 (*b*) is a cross sectional view.

Figure 17:
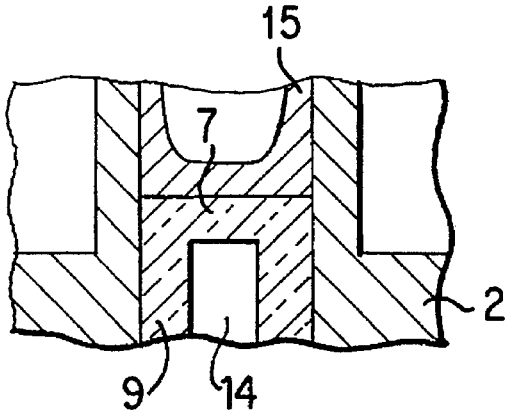
FIG. 17 is a view showing a state of growth of a solidified shell in the lower end of a mold in the embodiment 4.

FIG. 17 is a view showing the growing state of a solidified shell 15 in the vicinity of the center of the parallel portion at the lower end of a mold. A curve at an R portion is formed similarly to that of the embodiment 1. When a narrow side mold wall is entirely composed of the electric conductive refractory material 7, although a shell on the narrow side mold wall is about 4 mm thick in the embodiment 1, it is about 7 mm in this embodiment. When the parallel portion of the narrow side mold wall 1 arranged as a structure having a high cooling capability as in this embodiment, an amount of growth of a shell on the narrow side mold wall surface is increased, which is advantageous for the prevention of the occurrence of break-out.

Embodiment 7

Figure 18A:
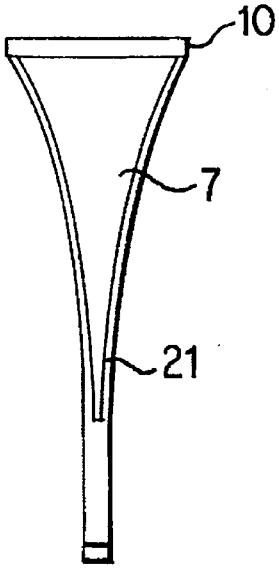
FIGS. 18A and 18B show the structure of a narrow side mold wall used in an embodiment 7.
Figure 18B:
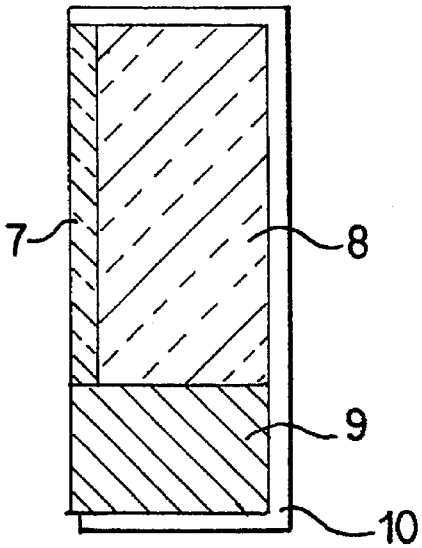

FIG. 18 shows a view of the structure of a narrow side mold wall of the continuous casting apparatus used in the embodiment. Although the narrow side mold wall is substantially similarly arranged as that of the embodiment 1, a narrow side edge 21 of 3 mm wide is disposed to the portion where the narrow side mold wall 1 is in contact with a wide side mold wall 2. The narrow side edge 21 is composed of copper alloy similar to that used in the wide side mold wall 2 and the surface of the narrow side edge 21 in contact with molten metal is composed of a Ni plated lower layer and a Cr plated surface layer. The provision of the narrow side edge 21 with the narrow side mold wall 1 as in this embodiment increases the strength, in particular, the tenacity of the portion of the narrow side mold wall in contact with the wide side mold wall. As a result, there is a less possibility that when a width is changed, the portion of the narrow side mold wall in contact with the wide side mold wall is damaged by the sliding of the wide side mold wall. Consequently, even if an on-line width is changed while casting is carried out, the possibility of the occurrence of trouble is reduced.

Embodiment 8

Figure 19:
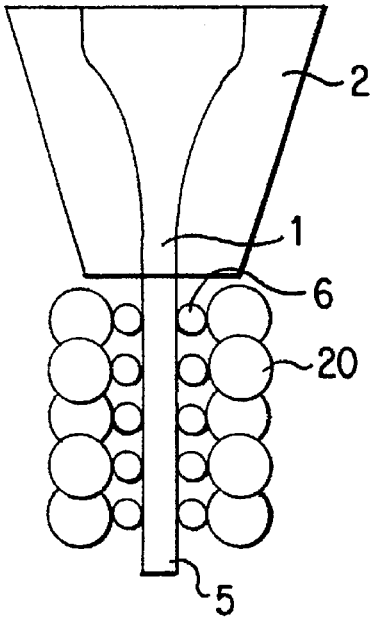
FIG. 19 schematically illustrates a continuous casting apparatus used in an embodiment 8 (type A)
Figure 20:
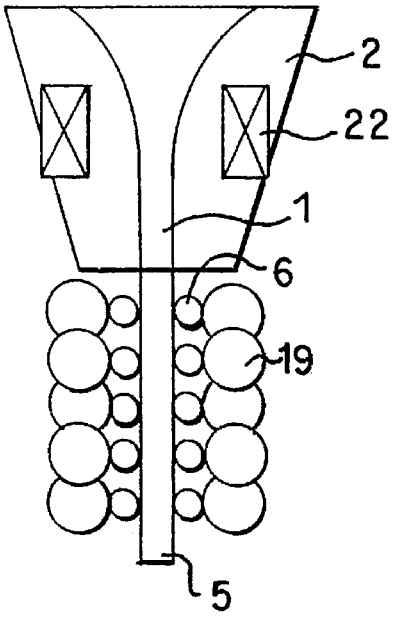
FIG. 20 schematically illustrates a continuous casting apparatus used in the embodiment 8 (type B)

FIG. 19 and FIG. 20 show continuous casting apparatuses of other embodiments. In FIG. 19, the vicinity of a wide side mold wall 2 is formed perpendicularly and a portion connected to an R portion is formed to a curved line (type A). Further, in FIG. 20, an electric conductive coil 22 is disposed on the backside of a wide side mold wall and a current flows to the coil 22 (type B). Both the type A and type B are arranged completely similarly to the embodiment 3 except the above-mentioned. According to the type A, a gap is liable to be formed between the mold and a solidified shell. Thus, mold powder can easily flow between the mold and the solidified shell so that lubricability therebetween is improved. According to the type B, since an electromagnetic force acts on molten metal due to the current flowing to the electric conductive coil 22, a force is applied in a direction for exfoliating the molten metal from the mold. With this arrangement, a gap is liable to be produced between the mold and a solidified shell so that lubricability between the mold and the solidified shell is improved by the same reason as above. This technology is applied to the continuous casting apparatus of the present invention to exhibit a novel effect of stably casting a thin ingot at high speed. As described above, the type A and the type B exhibit the same effect, although they employ a different method, and effectively contribute to carry out casting stably.

Embodiment 9

Figure 21:
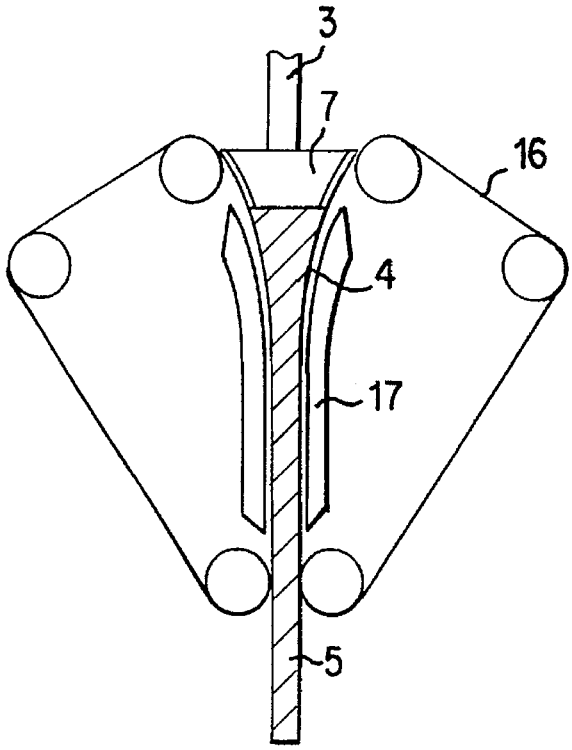
FIG. 21 schematically illustrates a twin belt type continuous casting apparatus used in an embodiment 9.

As shown in FIG. 21, a twin-belt type continuous casting apparatus used in the embodiment employs belts as wide side mold walls which move in synchronism with an ingot and narrow side mold walls composed of fixed molds.

Figure 22:
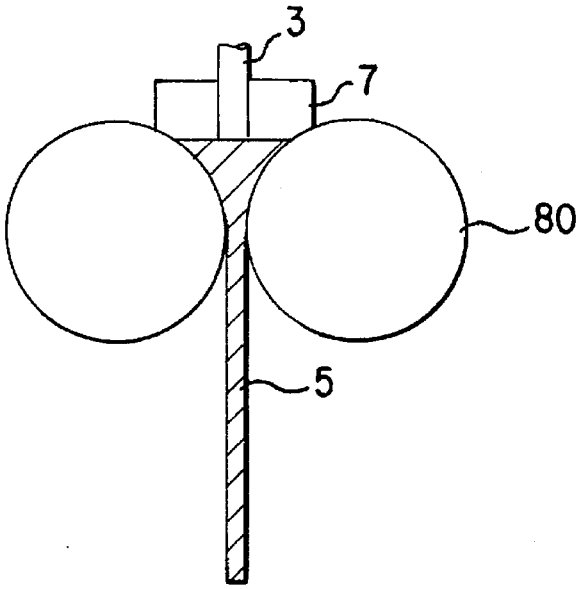
FIG. 22 schematically illustrates a twin roll type continuous casting apparatus used in the embodiment 9.
Figure 23A:
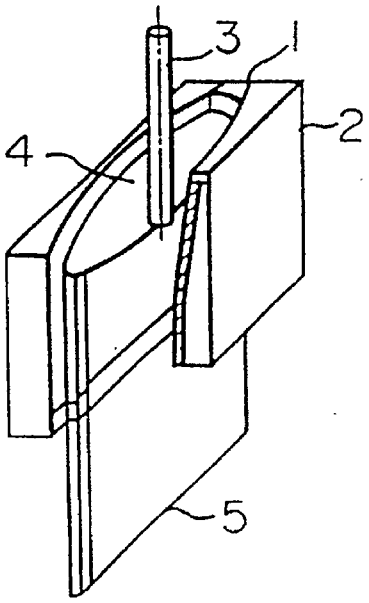
FIGS. 23A–23D are perspective views of a fixed mold used in an embodiment 10.
Figure 23B:
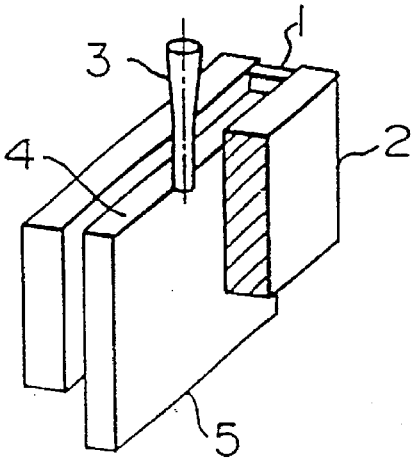
Figure 23C:
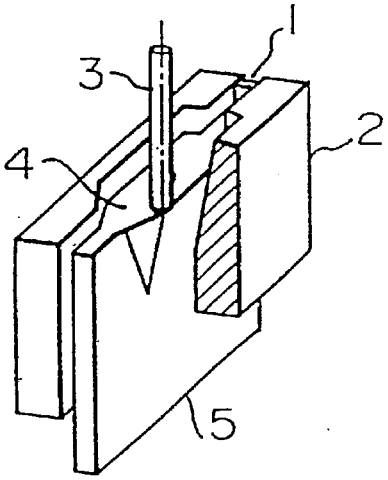
Figure 23D:
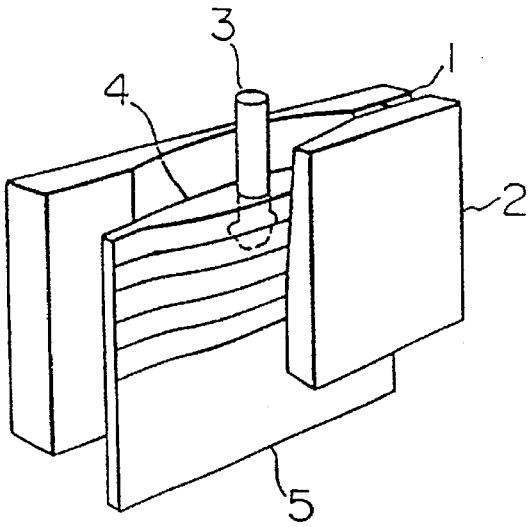

A twin-roll type continuous casting apparatus shown in FIG. 22 employs rolls 80 as wide side mold walls which move in synchronism with an ingot and narrow side mold walls composed of fixed molds. Both the continuous casting apparatuses are common in that the width of the narrow side mold walls is narrowed from the surface of molten metal toward a casting direction. An electric conductive refractory material 7 is used to the surface of the narrow side mold walls of these apparatuses so that the narrow side mold walls can be heated. With this arrangement, the creation of a narrow side shell can be prevented, whereby casting can be stably carried out as well as the quality of an ingot end portion can be improved.

Embodiment 10

FIG. 23 is a perspective view showing a wide side mold wall 2 by way of example. The front view of a narrow side mold wall 1 shown is FIG. 2 (*a*) is formed as shown in FIGS. 23 (*a*)–(*d*), whereas the side view of the narrow side mold wall 1 shown in FIG. 2 (*b*) is the same all together. Therefore, the length of the R portion and the length of the parallel portion shown in the embodiment 1 are substantially similarly allocated to a heating portion and a cooling portion. A continuous casting apparatus and a rolling system similar to those of the embodiment 1 can be arranged using the mold formed to the shape as described above.

Although the wide side mold walls 2 of the mold of the embodiment is arranged linearly with respect to a casting direction, they may be curved in the same way as the embodiment 1.

According to the present invention, the upper portion of the mold is formed to a wide shape and the lower portion thereof is formed to a narrow shape. As a result, the molten metal pouring nozzle can be easily inserted into the upper portion from the tundish and a thin ingot is drawn out from the outlet of the mold, whereby a thin ingot can be made.

According to the present invention, since the narrow side mold walls can be heated to high temperature, the creation of a solidified shell can be prevented on the surfaces of the narrow side mold walls. Consequently, a drawing resistance is not caused in a squeezing process by a solidified shell on the surfaces of the narrow side mold walls, so that casting can be stably carried out at high speed.

According to the present invention, an ingot is supported by a belt or the like as a secondary cooling system, which is effective for the prevention of bulging. Thus, there is an effect that casting can be effected at high speed.

According to the present invention, since an electromagnetic force can be applied to molten metal, a gap is liable to be produced between the fixed mold and a solidified shell between the mold and a molten metal surface, and thus mold powder can easily flow into the gap. Consequently, there is an effect that the occurrence of break-out caused by the insufficient lubrication between the mold and the solidified shell can be reduced.

According to the present invention, since the thickness of an obtained ingot is reduced, a rolling reduction until the ingot is finished to a final thickness can be reduced. Consequently, the number of necessary rolling mills is reduced so that the length of a rolling line can be shortened. Thus, the equipment cost and maintenance cost of the rolling equipment can be reduced and the price of rolled products can be reduced accordingly.

What is claimed is:

1. A continuous casting apparatus for continuously manufacturing an ingot from molten metal, comprising:

a fixed mold formed by facing wide side mold walls and facing narrow side mold walls, said fixed mold receiving a molten metal, each of said narrow side mold walls comprising an upper squeezed portion and a lower parallel portion, said upper squeezed portion having a surface in contact with the molten metal which converges in width along a casting direction, said lower parallel portion having a surface in contact with the molten metal which is substantially uniform in width, and a heater disposed on the upper squeezed portion, said heater heating the narrow side mold walls over a full extent of said upper squeezed portion in contact with the molten metal.

2. A continuous casting apparatus according to claim 1, wherein said heater is arranged on the surface of the upper squeezed portion of each of said narrow side mold walls in contact with the molten metal so that the molten metal is not solidified on the respective upper squeezed portions of said narrow side mold walls.

3. A continuous casting apparatus according to claim 1, further comprising:

temperature measuring means provided proximate each of said narrow side mold walls in contact with the molten metal; and control means for effecting control so that the temperature of the narrow side mold walls can be controlled to an arbitrarily set temperature prior to and during casting.

4. A continuous casting apparatus according to claim 3, wherein the heating temperature of the surface of the squeezed portion of each of said narrow side mold walls in contact with the molten metal is controlled to a temperature higher than the liquidus temperature of the molten metal.

5. A continuous casting apparatus according to claim 3, further comprising a vibration unit arranged and configured to vibrate said fixed mold in said casting direction.

6. A continuous casting apparatus according to claim 1, wherein said narrow side mold walls can be selectively moved in a widthwise direction of the ingot regardless of whether casting is being carried out or not.

7. A continuous casting apparatus according to claim 1, further comprising support rolls provided on an outlet side of and below said fixed mold to prevent expansion of the ingot due to the static pressure of the molten metal.

8. A continuous casting apparatus according to claim 7, wherein back-up rolls are provided in contact with said support rolls to back up said support rolls.

9. A continuous casting apparatus according to claim 1, wherein an end of the upper squeezed portion of said narrow side mold walls which is in contact with said wide side mold walls is formed of a material which is identical to a material from which said wide side mold walls are formed, axed has a thickness (d) which is measured in the thicknesswise direction of the ingot which is not more than a thickness (t) of the ingot.

10. A continuous casting apparatus according to claim 1, wherein the surface of the upper squeezed portion of each of said narrow side mold walls which contacts the molten metal is composed of an electrically conductive refractory material which is heated by being electrically energized.

11. A continuous casting apparatus according to claim 1, further comprising a unit for applying an electromagnetic force from said wide side mold walls to the molten metal in said fixed mold.

12. A continuous casting apparatus according to claim 1, further comprising a vibration unit arranged and configured to vibrate said fixed mold in said casting direction.

13. A continuous casting apparatus according to claim 12, further comprising rolls consecutively provided downstream of said fixed mold and adapted to rotate in synchronism with movement of the ingot to support the ingot.

14. A continuous casting apparatus according to claim 12, wherein a side of said parallel portion which contacts the molten metal is composed of a water-cooled metal body.

15. A continuous casting apparatus according to claim 1, wherein said upper squeezed portion is arcuate in shape and has a radius of curvature of 1500 to 5000 mm.

16. A continuous casting apparatus according to claim 1, wherein said upper squeezed portion of said narrow side mold walls is formed of an electrically conductive refractory material, is arcuate in shape, end has a radius of curvature of 1500 to 5000 mm, wherein said casting apparatus further comprises width varying means provided on said narrow side mold walls for optionally moving said narrow side mold walls in a widthwise direction of the ingot during casting and non-casting, and wherein an end of said upper squeezed portion which contacts said wide side mold walls is formed of a material which is identical to a material from which said wide side mold walls are formed.

17. A continuous casting apparatus according to claim 1, wherein said heater heats a side of said upper squeezed portion which contacts the molten metal to a higher temperature than the liquidus temperature of the molten metal, wherein said upper squeezed portion is formed of an electrically conductive refractory material, is arcuate in shape, and has a radius of curvature of 1500 to 5000 mm, wherein a side of said lower parallel portion which contacts the molten metal is composed of a watercooled metal body, and wherein said apparatus further comprises rolls consecutively provided downstream of said fixed mold and adapted to rotate in synchronism with movement of the ingot to support the ingot.

18. A continuous casting apparatus comprising:

a fixed mold formed by facing wide side mold walls and facing narrow side mold walls, said narrow side mold walls forming a squeezed portion with decreasing width in a casting direction and an adjoining constant width section leading from the squeezed portion to a mold outlet, and a heater heating the narrow side mold walls over a full extent of said squeezed portion.

19. A method of continuously casting on ingot from molten metal, comprising the steps of:

continuously supplying a molten metal to a fixed mold, said fixed mold formed by facing wide side mold walls and facing narrow side mold walls, each of said narrow side mold walls comprising an upper squeezed portion and a lower parallel portion, said upper squeezed portion having a surface in contact with the molten metal which converges in width along a casting direction, said lower parallel portion having a surface in contact with the molten metal which is substantially uniform in width, and heating said molten metal which is in contact with said upper squeezed portion over a full extent of said upper squeezed portion.

* * * * *